United States Patent [19]

Perron

[11] 4,217,906

[45] Aug. 19, 1980

[54] SHOULDER STRAPS

[75] Inventor: Reginald F. Perron, Chambly, Canada

[73] Assignee: Hubscher Ribbon Corporation Ltd., Montreal, Canada

[21] Appl. No.: 940,402

[22] Filed: Sep. 7, 1978

[51] Int. Cl.[2] ..... A41C 3/00

[52] U.S. Cl. ..... 128/510

[58] Field of Search ..... 128/284, 286, 510; 112/265

[56] References Cited

U.S. PATENT DOCUMENTS

| | | | |
|---|---|---|---|
| 3,153,246 | 10/1964 | Silverman | 128/510 |
| 3,561,073 | 2/1971 | Rosser | 112/265 |
| 3,616,148 | 10/1971 | Edelman | 128/510 |
| 3,873,403 | 3/1975 | Edelman | 128/510 |

*Primary Examiner*—Werner H. Schroeder
*Assistant Examiner*—Doris L. Troutman
*Attorney, Agent, or Firm*—Robert F. Delbridge; Arne I. Fors

[57] ABSTRACT

A shoulder strap has upper and lower outer portions extending from one side edge of the strap to the other, the upper and lower portions having laterally inturned side positions at at least one side edge of the strap, and a double layer of filler strip located between the upper and lower outer portions. The upper filler strip layer has a side edge portion located between the upper outer portion and an adjacent laterally inturned side portion thereof, and the lower filler strip layer has a side edge portion located between the lower outer portion and an adjacent laterally inturned side portion thereof. Each adjacent laterally inturned side portion is short compared to the width of the strip so as to leave substantial portions of the width of the filler strip layers adjacent each other. Adjacent portions of the filler strip layers are bonded together by a strip of synthetic plastic material extending longitudinally of the strap and of such a width that the strip of synthetic plastic material terminates short of each side edge of the strap formed by adjacent laterally inturned side portions. Each pair of adjacent laterally inturned side portions is bonded together by a separate length of synthetic plastic material extending longitudinally of the strap.

9 Claims, 1 Drawing Figure

SHOULDER STRAPS

Figure 1:
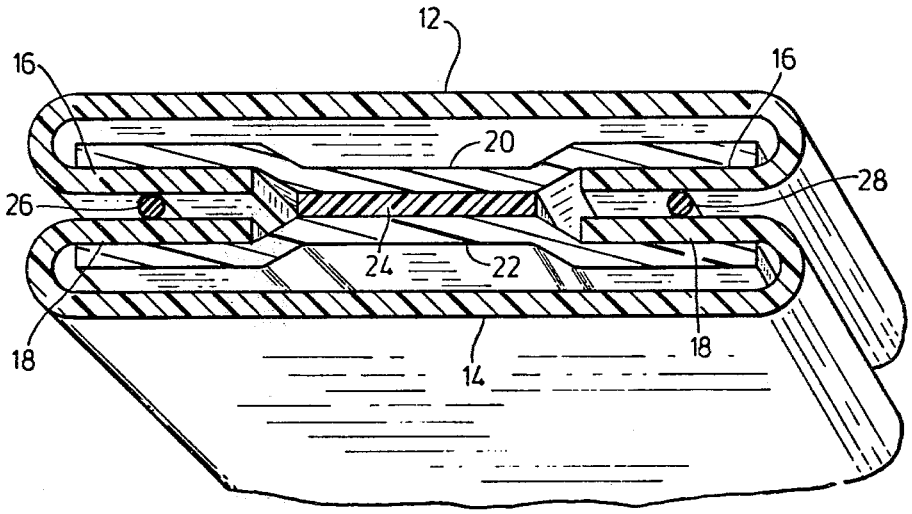

This invention relates to shoulder straps for ladies' garments.

Canadian Patent Nos. 944,502 and 944,503, which issued on Apr. 2, 1974, describe shoulder straps which have a seam at one or both side edges, there being no seams in the upper or lower surfaces of the straps. The exterior of the straps is formed by a suitable outer material such as nylon tricot, and double layers of filler strips of suitable material such as cotton fabric are located within the outer material. In each strap, portions of the layers of filler strips are bonded together, as are also the adjacent layers of outer material which form the side seam or seams, by a strip of synthetic plastic material, thereby avoiding the necessity of having any stitching in the strap.

With some straps of this kind, it has been found that the strip of synthetic plastic material is caused to protrude out of the side seam or seams during the manufacturing process, which includes the application of heat and pressure to cause the strip of synthetic plastic material to effect its bonding function. This may cause the seam edge or edges of the strap to become hard and/or irritable to the wearer.

The present invention accordingly provides a shoulder strap comprising upper and lower outer portions extending from one side of the strap to the other, the upper and lower portions having laterally inturned side portions at at least one side edge of the strap, a double layer of filler strip located between the upper and lower outer portions, the upper filler strip layer having a side edge portion located between the upper outer portion and an adjacent laterally inturned side portion thereof and the lower filler strip layer having a side edge portion located between the lower outer portion and an adjacent laterally inturned side portion thereof, each said adjacent laterally inturned side portion being short compared to the width of the strip so as to leave substantial portions of the width of the filler strip layers adjacent each other, said adjacent portions of the filler strip layers being bonded together by a strip of synthetic plastic material extending longitudinally of the strap and of such a width that said strip terminates short of the or each side edge of the strap formed by adjacent laterally inturned side portions, and the or each pair of adjacent laterally inturned side portions being bonded together by a separate length of synthetic plastic material extending longitudinally of the strap.

The cross-section of the or each separate length of synthetic plastic material can accordingly be chosen so that the problem mentioned above is avoided, while at the same time effective bonding continues to be achieved by the strip of synthetic plastic material.

The upper and lower outer portions may have laterally inturned side portions at both side edges of the strap, with adjacent laterally inturned side portions at each side of the strap being bonded together by separate lengths of synthetic plastic material extending longitudinally of the strap.

The strip of synthetic plastic material may be of such a width that the strip also bonds together the innermost edge parts of adjacent laterally inturned side portions. In this case, the strip of synthetic plastic material may also bond the innermost edge parts of adjacent laterally inturned side portions to adjacent parts of the filler strips.

The or each length of synthetic plastic material may also bond the laterally inturned side portions to the respective filler strip layers.

The upper and lower outer portions may be of nylon tricot, and the filler strips may be of cotton flannel. The strip of synthetic plastic material may comprise a web of synthetic thermoplastic fibres, and the or each length of synthetic plastic material may comprise a mono-filament thread.

One embodiment of the present invention will now be described, by way of example, with reference to the accompanying drawing, which shows a cross-sectional view of a strap.

Referring to the drawing, a strap suitable for ladies' garments has an upper outer portion 12 and a lower outer portion 14 of nylon tricot, and each outer portion 12, 14 has laterally inturned side portions 16, 18 respectively forming seams at each side edge of the strap. Each inturned side portion is short compared to the width of the strap so as to leave a gap of substantial width relative to the width of the strap between opposed ends of respective inturned side postions 16, 18.

A first filler strip 20 of cotton fabric, such as cotton flannel, is located between the upper outer portion 12 and the inturned side portions 16 thereof. A second filler strip 22 of similar material is located between the lower outer portion 14 and the inturned side portions 18 thereof.

Central portions of the widths of the filler strips 20, 22 are bonded together, through the gaps between the inturned side portions 16, 18, by a strip of synthetic plastic material in the form of a web of thermoplastic fibres 24. The web 24 is of such a width that it also bonds together the innermost edge parts of adjacent inturned side portions 16, 18. The web 24 may also bond the innermost edge parts of inturned side portions 16, 18 to adjacent parts of the filler strips 20, 22. However, the side edges of the web 24 terminate well short of the side edges of the strap and, laterally outwardly of the web 24, adjacent inturned side portions 16, 18 are bonded together by separate lengths of mono-filament thermoplastic thread 26, 28. The threads 26, 28 may also bond the inturned side portions 16, 18 to adjacent parts of the filler strips 20, 22. The bonding is such that the filler strips 20, 22 are not bonded to the nylon tricot outer portions 12, 14.

The strap is manufactured in a similar manner to that described in the abovementioned Canadian Patent No. 944,503, except that the web 24 is narrower in this case, and the mono-filament threads 26, 28 are fed into the strap before the bonding and curing steps. With the present invention, the web 24 is sufficiently narrow to avoid any possibility of its side edges projecting from the side seams of the strap, while at the same time being of a sufficient size to achieve the necessary bonding. The mono-filament threads 26, 28 are sufficiently large to bond the adjacent laterally inturned portions 16, 18 together to form secure side seams, while at the same time being sufficiently small to avoid the likelihood of thermoplastic material constituting the threads 26, 28 from being forced out of the side seams during the bonding and curing steps.

The above described embodiment of the present invention is an improvement in the double side seam strap described and claimed in Canadian Patent No. 944,503. It will readily be understood that the present invention is equally applicable to the single side seam strap described and claimed in Canadian Patent No. 944,502.

Other embodiments of the present invention will be clearly apparent to a person skilled in the art.

What I claim as new and desire to protect by Letters Patent of the United States is:

1. A shoulder strap comprising upper and lower outer portions extending from one side edge of the strap to the other, the upper and lower portions having laterally inturned side portions at at least one side edge of the strap, a double layer of filler strip located between the upper and lower outer portions, the upper filler strip layer having a side edge portion located between the upper outer portion and an adjacent laterally inturned side portion thereof, and the lower filler strip layer having a side edge portion located between the lower outer portion and an adjacent laterally inturned side portion thereof, each said adjacent laterally inturned side portion being short compared to the width of the strip so as to leave substantial portions of the width of the filler strip layers adjacent each other, said adjacent portions of the filler strip layers being bonded together by a strip of synthetic plastic material extending longitudinally of the strap and of such a width that said strip of synthetic plastic material terminates short of each side edge of the strap formed by adjacent laterally inturned side portions, and each pair of adjacent laterally inturned side portions being bonded together by a separate length of synthetic plastic material extending longitudinally of the strap.

2. A shoulder strap according to claim 1 wherein said upper and lower outer portions have laterally inturned side portions at both side edges of the strap, with adjacent laterally inturned side portions at each side of the strap being bonded together by separate lengths of synthetic plastic material extending longitudinally of the strap.

3. A shoulder strap according to claim 1 wherein the strip of synthetic plastic material is of such a width that said strip also bonds together the innermost edge parts of adjacent laterally inturned side portions.

4. A shoulder strap according to claim 3 wherein the strip of synthetic plastic material also bonds the innermost edge parts of adjacent laterally inturned side portions to adjacent parts of the filler strips.

5. A shoulder strap according to claim 1 wherein each length of synthetic plastic material also bonds the laterally inturned side portions to the respective filler strip layers.

6. A shoulder strap according to claim 1 wherein the upper and lower outer portions are of nylon tricot.

7. A shoulder strap according to claim 1 wherein the filler strips are of cotton flannel.

8. A shoulder strap according to claim 1 wherein the strip of synthetic plastic material comprises a web of synthetic thermoplastic fibres.

9. A shoulder strap according to claim 1 wherein each length of synthetic plastic material comprises a monofilament thread.

* * * * *